US007753218B2

(12) United States Patent
Moss et al.

(10) Patent No.: US 7,753,218 B2
(45) Date of Patent: Jul. 13, 2010

(54) TILT BACK MERCHANDISE DISPLAY STAND

(76) Inventors: Geoffrey Alan Moss, 149 Ardwell Crescent, Maple, Ontario (CA) L6A 1W3; David Brian Minister, 81 Cheryhill Drive, Maple, Ontario (CA) L6A 1H7

( * ) Notice: Subject to any disclaimer, the term of this patent is extended or adjusted under 35 U.S.C. 154(b) by 0 days.

(21) Appl. No.: 12/321,865

(22) Filed: Jan. 28, 2009

(65) Prior Publication Data

US 2009/0140118 A1 Jun. 4, 2009

Related U.S. Application Data

(62) Division of application No. 11/402,367, filed on Apr. 10, 2006.

(51) Int. Cl.
*A47F 3/06* (2006.01)
*A47F 5/11* (2006.01)

(52) U.S. Cl. ..... 211/133.3; 211/149

(58) Field of Classification Search ..... 211/72, 211/149, 73, 135, 13.1, 195, 186, 189, 132.1, 211/88.01, 133.3; 248/459, 174, 152, 135, 248/150; 206/750, 45.24, 764, 743; 220/6; 108/115

See application file for complete search history.

(56) References Cited

U.S. PATENT DOCUMENTS 1,342,313 A * 6/1920 Stranders ..... 248/174
1,491,091 A * 4/1924 Flynn ..... 211/135
2,062,165 A * 11/1936 Davidson ..... 211/135
3,836,104 A * 9/1974 Miller et al. ..... 248/150
5,706,959 A * 1/1998 Smith ..... 248/174
5,826,732 A * 10/1998 Ragsdale ..... 211/149
6,098,820 A * 8/2000 Smith ..... 211/132.1
6,234,433 B1 * 5/2001 Maglione ..... 248/174
D493,309 S * 7/2004 Moss et al. ..... D6/510
6,929,133 B1 * 8/2005 Knapp et al. ..... 211/118
6,966,447 B2 * 11/2005 Hiltke et al. ..... 211/132.1
7,070,057 B2 * 7/2006 Moss et al. ..... 211/132.1
7,367,539 B2 * 5/2008 Moss et al. ..... 248/460
2005/0184015 A1 * 8/2005 Cypranowski et al. ..... 211/73

* cited by examiner

*Primary Examiner*—Michael Safavi
*Assistant Examiner*—Stanton L Krycinski
(74) *Attorney, Agent, or Firm*—David W. Wong

(57) ABSTRACT

A tilt back merchandise display stand has a front panel tilted at the top rearwardly to its rear panel. The stand has two triangular side panel foldable inwardly along two vertical middle fold lines. A horizontal fold line formed at the middle position of the stand so that the stand may be folded into a collapsed condition. A single large rectangular merchandise display shelving or two separate merchandise display shelving may be mounted to the front panel with S-shaped hooks mounted to open mounting slots formed at the top edge and at the horizontal fold line of the front panel. A plurality of separate merchandise display trays with upper L-shaped tabs may also be mounted to the front panel with a plurality of vertical mounting slots formed along its side edges. The display stand is self-erectable with the provision of an elastic cord mounted between a brace panel and the rear panel within the stand.

1 Claim, 7 Drawing Sheets

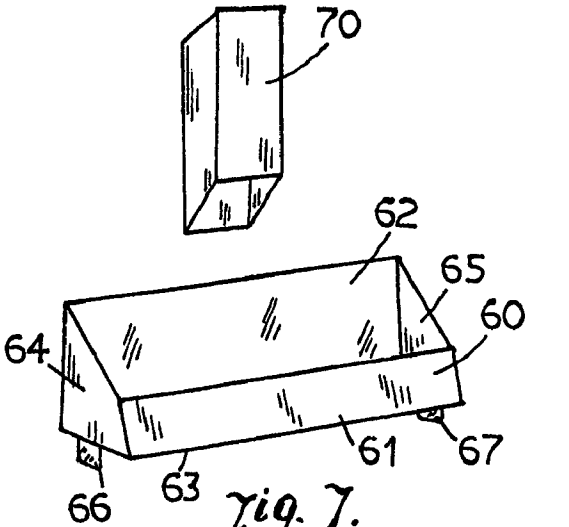
Fig. 7.
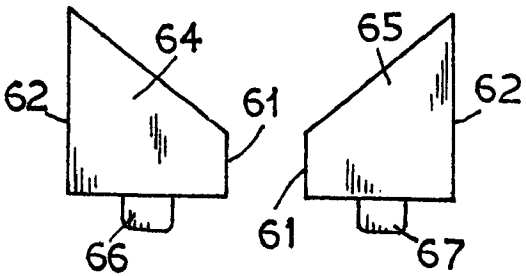
Fig. 8.
Fig. 9.
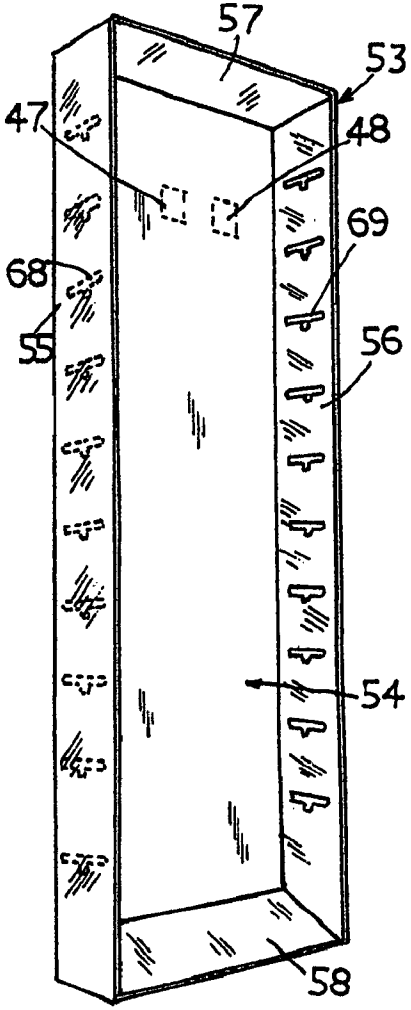
Fig. 6.
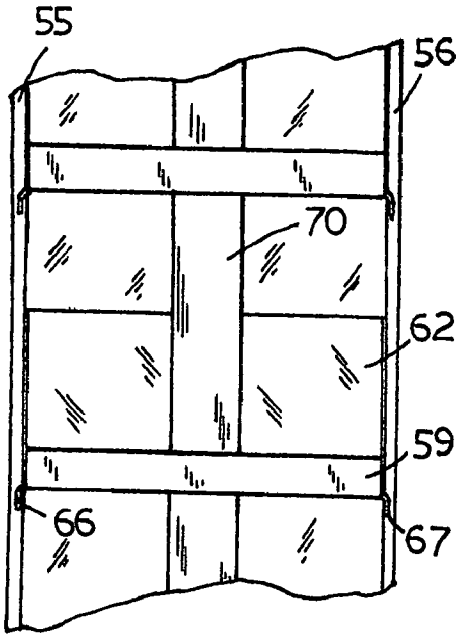
Fig. 10.

TILT BACK MERCHANDISE DISPLAY STAND

This application is a divisional application of U.S. patent application Ser. No. 11/402,367 filed Apr. 10, 2006 by the same inventors of this application.

BACKGROUND OF THE INVENTION

1. Field of the Invention

This invention relates to merchandise display stands and more particularly display stands made of cardboard or corrugated paper board or plastic material such as CORROPLAST (a trade mark) having a foldable and vertical support stand with merchandise containing cases or trays removably mounted on the front of the support stand. The display stand may be erected readily at the field location with ease.

2. Background Art

Heretofore there are numerous types of merchandise stands. Some display stands consist of a merchandise containing case resting horizontally on top of a support stand. Other display stands consist of a merchandise containing case merely resting in a substantially vertical position on a pedestal or shelve provided in front of a vertical stand. In the latter type of display stand the merchandise case is not securely mounted to the support stand such that it can easily separate or fall off from the stand accidentally. Furthermore, most of the support stands require time consuming assembly and erection and they are awkward to assemble; particularly if a large number of such display stands are to be erected at the same time it would be very time consuming to assemble them. The display stand may not be pre-assembled as an integral single unit, since the unmounted merchandise case could easily become separated. Thus, they must be transported in a separated manner. The separate support stand and merchandise case would occupy separate available spaces in the transporting vehicle thus resulting in the inefficient use of the available space in the transporting vehicle because of less number of display stands that can be transported.

SUMMARY OF THE INVENTION

It is a principal object of the present invention to provide merchandise display stands which can be easily and readily erected.

It is another object of the present invention to provide merchandise display stands in which the support stand is foldable in storage or in transportation.

It is another object of the present invention to provide merchandise display stands in which the support stand is self-erectable from the folded condition.

It is another object of the present invention to provide merchandise display stands in which the merchandise carrying containers are securely mounted to the support stand.

It is still another object of the present invention to provide merchandise display stands in which the support stand and the merchandise carrying containers may be pre-assembled and mounted together for transportation for efficient use of the available space in the transporting vehicle.

BRIEF DESCRIPTION OF THE DRAWINGS

The above objects and other advantages and embodiments of the invention will become apparent from reading the accompanying description, with reference to the accompanying drawings in which

FIG. 6 is a front and left perspective view of the frame of the merchandise display casing showing the tray mounting slots formed in its side walls.

FIG. 7 is an exploded perspective front view of the merchandise display shelving mountable in the display casing and the reinforcing support column.

FIG. 8 is a side elevation view of the left side wall of the display shelving.

FIG. 9 is a side elevation view of the right side wall of the display shelving.

FIG. 10 is an isolated front elevation view showing the mounting of the display shelving to the display casing.

DETAILED DESCRIPTION OF THE PREFERRED EMBODIMENTS

Figure 1:
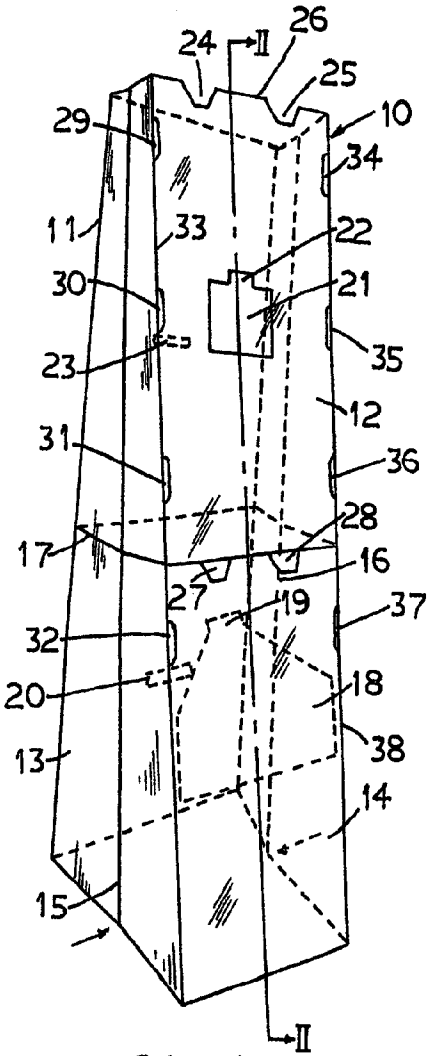
FIG. 1 is a front and left side perspective elevation view of the foldable support stand of the merchandise display stand according to the present invention.
Figure 2:
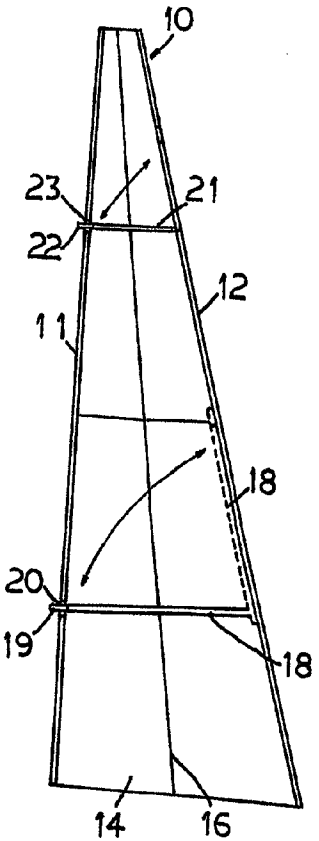
FIG. 2 is a cross sectional side elevation view along section line II-II of FIG. 1.

With reference to the drawings in which same parts are designated with corresponding reference numerals in the several views, the merchandise support of the present invention has a support stand 10 having a substantially vertical rectangular rear panel 11 and a rectangular front panel 12 which is slanted rearwards at its top towards the rear panel 11. The support stand 10 has two triangular side panels 13 and 14. The right side panel 14 is shown in dotted line in FIG. 1. The support stand 10 may therefore rest securely on a support surface in an erected condition with the front panel 11 leaning in a rearwardly slanting position as best shown in FIG. 1. The side panels 13 and 14 are foldable along middle vertical fold lines 15 and 16 respectively by pushing them inwards towards one another at these vertical fold lines as shown by two arrows in which the right arrow is shown in dotted line. A horizontal fold line 17 is formed around the middle of the support stand 10 at the middle of the rear panel 10, the front panel 11, and the side panels 13 and 14 such that the entire support stand 10 may be folded to a collapse condition by first folding the side panels 13 and 14 inwards until the rear panel 10 and the front panel 11 are juxtaposed to one another and then further folding the top portion forward along the horizontal fold line 17 until it lies over the lower portion. The stand 10 may be unfolded to the erected condition with the reverse procedure. A brace panel 18 is mounted in a cantilever manner on the inside surface of the front panel. The brace panel 18 has a length equal to the cross sectional depth of the display stand and it has a mounting tab 19. The brace panel 18 may be pivoted to lie juxtaposed to the front panel 12 when the display panel 10 is in the collapse condition, and it may be pivoted to a generally horizontal position extending between the rear panel 11 and the front panel 12 with the mounting tab 19 engaging with a latching slot 20 formed in the rear panel 11 so as to maintain the display stand 10 is a rigid erected condition. Additionally, an upper brace panel 21 may be provided by a scored generally rectangular pattern formed in the upper portion of the front panel. The rectangular pattern has three scored sides and a foldable side pivotal relative to the front panel. A scored tab 22 is located directly opposite to the foldable side. The upper brace panel 21 also has a length equal to the cross sectional depth of the display stand at that position. The rectangular pattern may be pushed inward to pivot relative to its foldable side serving as a fold line so as to form the upper brace panel 21, and then positioning it in a generally horizontal position transverse of the display stand 10 until its mounting tab 22 engages with another latching slot 23 formed at the rear panel 11 of the display stand and located directly opposite to the foldable side of the rectangular pattern. The upper brace panel 21 provides additional rigidity to the display stand 10 in the erected condition. In order to fold the display stand 10 to the collapsed condition, the brace panel 19 and the additional upper brace panel 21 must first be pulled to disengage their mounting tabs 19 and 22 from the latching slots 20 and 23 respectively the brace panel 18 may be pivoted upward or downward to lie juxtapose to the front panel 12 and the upper brace panel 21 is pivoted back to the position juxtaposed to or lie in the opening in the front panel 12 formed by the pattern left behind when it is pushed in to form the upper brace panel 21. It can be understood, that alternatively, the brace panel 18 may be mounted to the rear panel 11 with the latching slot 20 formed in the front panel and the upper brace panel 21 may be formed in the rear panel with the second mounting slot 23 formed in the front panel 12 to provide the same purposes.

Two equally spaced opened slots 24 and 25 are formed at the upper edge 26 of the front panel 12. Two similar slots 27 and 28 are formed at the horizontal fold line 17 in the front panel 12. A plurality of evenly spaced vertical slots 29, 30, 31 and 32 are formed at the left edge 33 of the front panel 12 and corresponding evenly spaced vertical slots 34, 35, 36 and 37 are formed at the right edge 38 of the front panel 12 and located directly opposite to the vertical slots 29, 30, 31 and 32 respectively.

Figure 3:
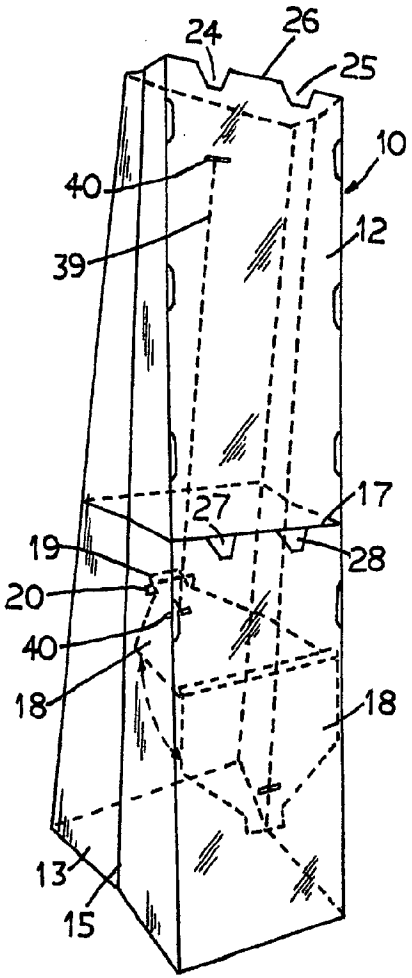
FIG. 3 is a front and left side perspective elevation view of the foldable self-erecting support stand of the merchandise display stand according to the present invention.
Figure 4:
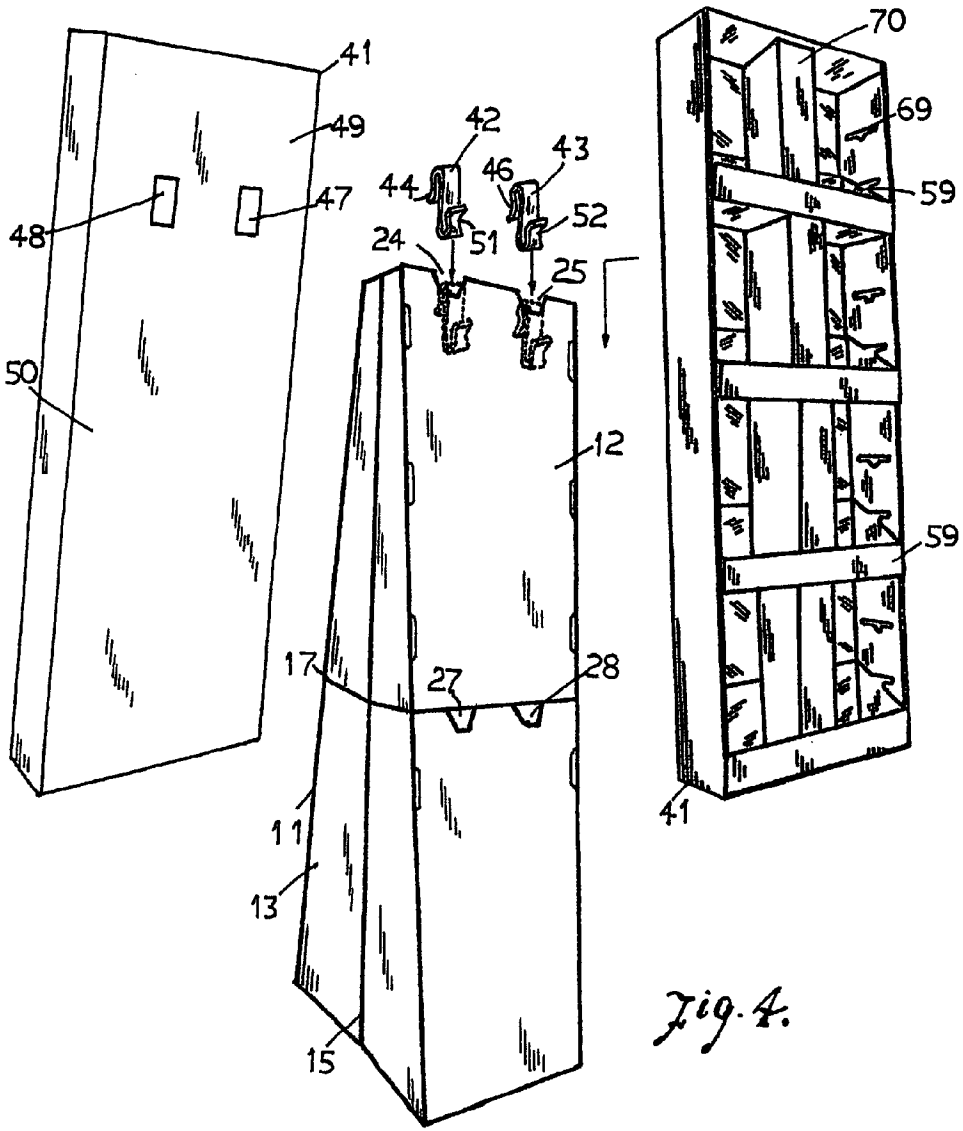
FIG. 4 is an exploded perspective elevation view showing the separate component parts of the merchandise display stand having a single large merchandise display casing.
Figure 5:
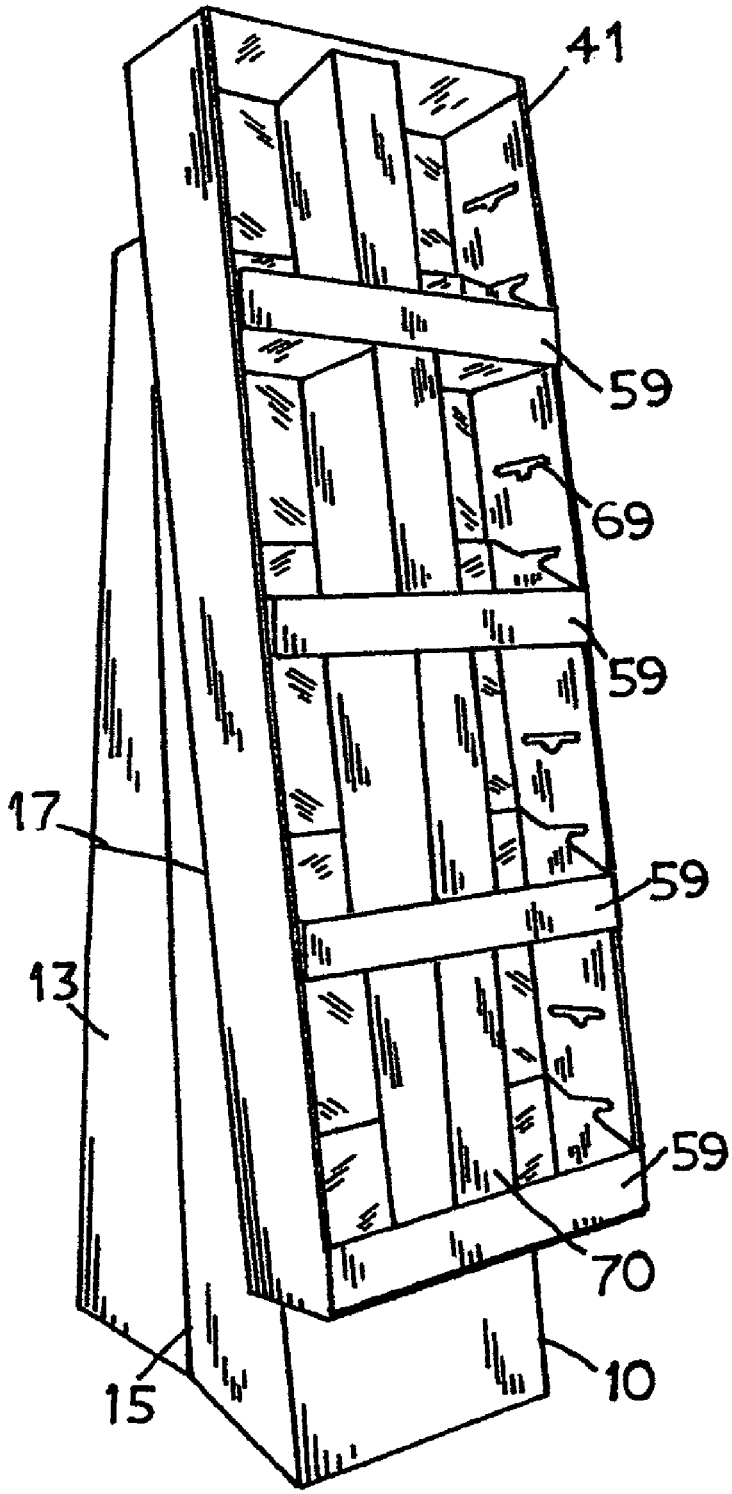
FIG. 5 is a front and left side perspective elevation view of the merchandise display stand of FIG. 4 in the fully assembled condition.

As shown in FIG. 3, the brace 35 an elastic cord 39 may be mounted between the brace panel 18 and the rear panel 11. The ends of the elastic cord 39 may be mounted to the brace panel 18 and the rear panel 11 with short cross bars 40. The elastic cord 39 will be stretched in an elastic tension when the brace panel 18 is pivoted downward to lie juxtaposed to the front panel 12 for folding the display stand 10 to the collapsed condition. The folded display stand 10 in the collapsed condition may be readily erected by merely holding its top edge 26 and raising it upwards. The elastic tension of the elastic cord 39 will pivot the brace panel 18 upwards which, in turn, causes the lower half to unfold from the top half as well as forcing the folded side panels 13 and 14 to unfold. The brace 18 will pivot upwards further by the tension force of the elastic cord 39 until it assumes the horizontal position within the now erected support stand 10 with its tab 19 engaging with the latching slot 20 to maintain the support stand 10 in the fully rigid erected condition. This self-erecting operation may be carried out simply and readily by the operator with only one hand holding and lifting the top edge 26 upwards.

A rectangular merchandise display casing or shelving 41 can be readily and securely mounted to the slanted front panel 12 of the support stand 10 with two S-shaped slide hooks 42 and 43. The upper hooks 44 and 46 of the slide hooks 42 and 43 are slidably secured to the slots 24 and 25 of the top edge 26 of the front panel 12. Two slot openings 47 and 48 are formed in the rear surface 49 of the rear panel 50 of the casing 41. Thus, the merchandise display casing 41 may be securely hung onto the front panel 12 of the display stand 10 by slidably engaging the upper edge of the slot openings 47 and 48 with the lower hooks 51 and 52 respectively. The merchandise display casing 41 will also be tilted backward at the top similar to the front panel 12 of the display stand 10 to provide a clear view of the merchandise placed therein as well as a stable center of gravity for the entire display stand.

The merchandise display casing 41 consists of a rectangular frame 53 having a rectangular well 54 formed by left side wall 55, right side wall 56, top side wall 57, bottom side wall 58 and a rear panel 50. A plurality of tray shelving 59 are provided in the well 54 for carrying and displaying the merchandise for sale. The tray shelving 59 may be in the form of separate trays removably mounted within the well 54. As shown in FIG. 7, the tray shelving 59 has a rectangular tray 60 having a front wall 61, a rear wall 62 and a bottom panel 63. The rear wall 62 is higher than the front wall 61. As shown in FIGS. 8 and 9, the side walls 64 and 65 have a sloping top edge sloping from the higher rear wall 62 to the lower front wall 61. A mounting tab 66 extends downwards from the lower edge of the left side wall 64 and a similar mounting tab 67 extends downwards from the lower edge of the right side wall 65. A plurality of evenly spaced horizontal mounting slots 68 are formed in the left side wall 55 and a plurality of similar horizontal mounting slots 69 are formed in the right side wall 56 of the rectangular casing 53. The tray shelving 59 may be removably mounted within the rectangular casing 53 by positioning within the rectangular casing and then pushing downwards to engage its mounting tab 66 and 67 within mounting slots 68 and 69 respectively at the same level on the side walls 55 and 56 of the rectangular casing 53 as best shown in FIG. 10. Additional rectangular bracing columns 70 may be removably located between the tray shelving 59 to reinforce the shelving for supporting the weight of the merchandise placed therein.

Figure 11:
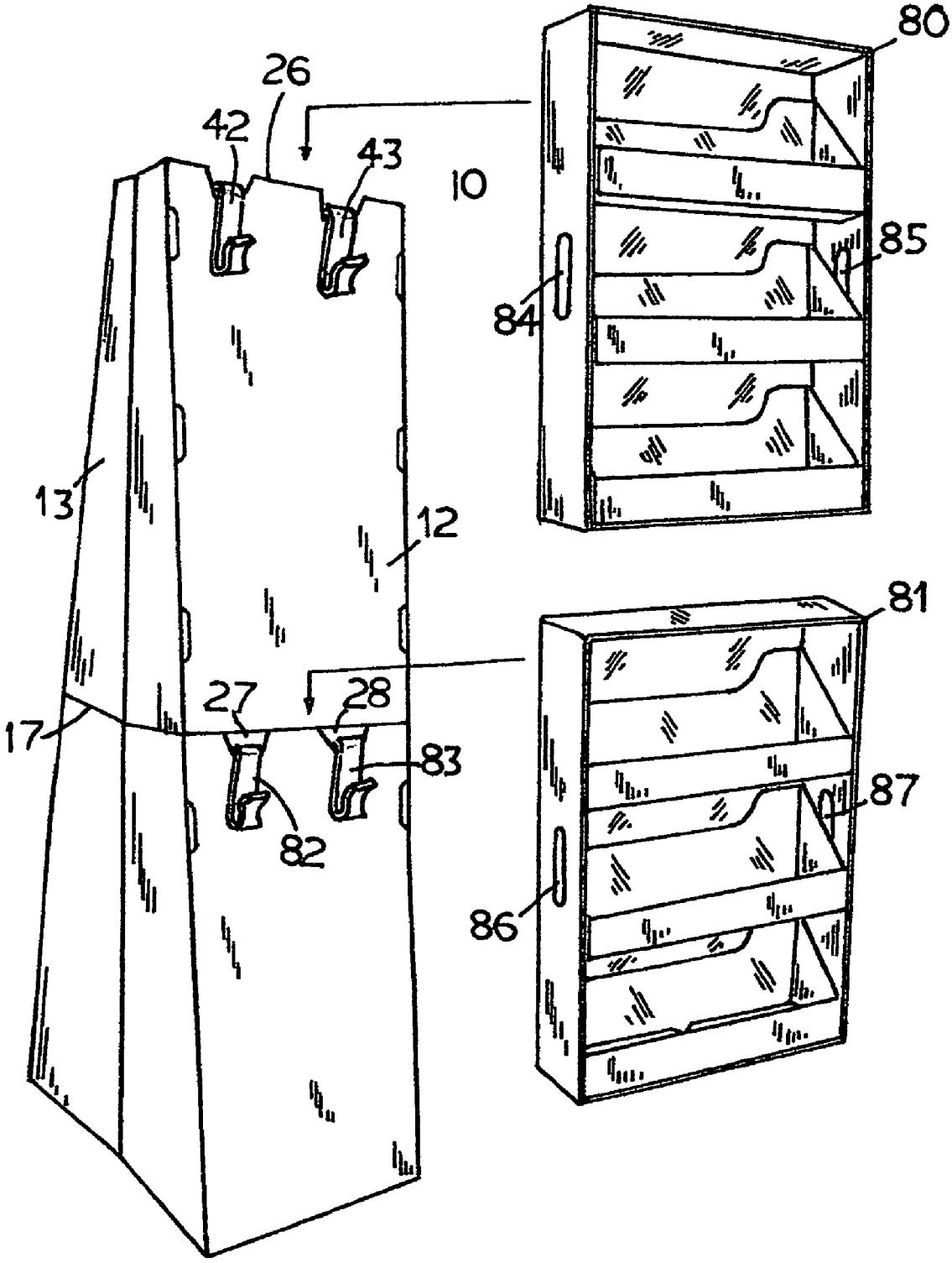
FIG. 11 is an exploded perspective front view of the merchandise display stand having two separable merchandise display casings removably mountable to the support stand.

The merchandise display casing 41 may be provided in two separate sections, namely, a top merchandise display casing 80 and a lower merchandise display casing 81 as shown in FIG. 11. Both of these separate display casings have two mounting openings formed in the rear surface of their rear panels similar to those of the single merchandise display casing 41. The top merchandise display casing 80 mountable on the top section of the front panel 12 of the display stand 10 by slidably engaging its rear mounting openings with the mounting hooks 42 and 43, and the lower merchandise display casing 81 may be removably and slidably mounted to two additional S-shaped mounting hooks 82 and 83 which are slidably mounted to the mounting slots 27 and 28 provided at the horizontal fold line 17. Handle openings 84 and 85 may be provided in the two side walls of the top merchandise display casing 80 and similarly handle openings 86 and 87 may be provided in the two side walls of the lower merchandise display casing 81 to facilitate easy handling of these merchandise display casing. Similar handle openings may also be provided on the side walls of the single merchandise display casing 41 for the same purpose.

Figure 12:
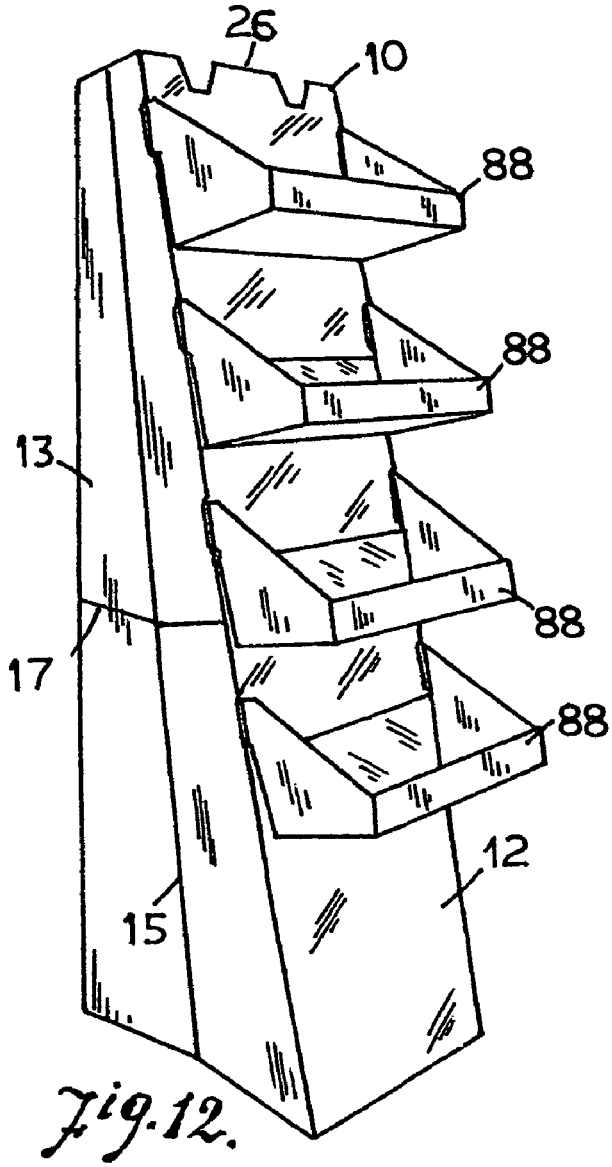
FIG. 12 is a front and left side perspective view of the merchandise display stand with a plurality of merchandise display trays removably mounted to its front panel.
Figure 13:
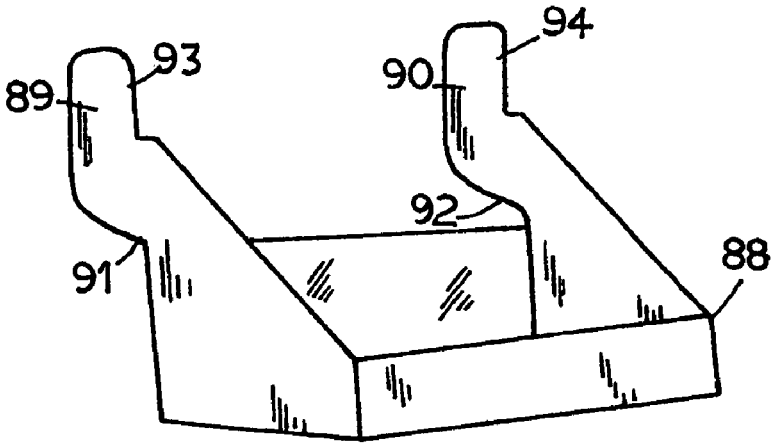
FIG. 13 is a front and left side perspective view of the merchandise display tray shown in FIG. 12.

A plurality of merchandise display trays 88 may be removably mounted on the front panel 12 of the display stand 10 as shown in FIG. 12. The display tray 88 has similar construction as the merchandise display shelve 59 with additional substantially L-shaped mounting tabs 89 and 90 extending rearwardly and upwardly from its two side walls respectively as shown in FIG. 13. The merchandise display trays 88 are removably mounted to the front panel 12 by engaging its mounting tabs 89 and 90 with selected pairs of vertical mounting slots 29 and 34, or 30 and 35, or 31 and 36, or 32 and 37. The display tray 88 is mounted by first inserting the mounting tabs 89 and 90 into the selected pair of mounting slots and then tilting the tray upwards and inwards towards the front panel 12 of the display stand 10 until the lower edges 91 and 92 resting on the lower edges of the mounting slots while the front edges 93 and 94 of the vertical portion of the mounting tabs abut the rear surface of the front panel 12. The rear surface of the rear panel of the display tray 88 will also abut the front panel 12 so that the display tray 88 is securely mounted to the front panel 12 of the display stand 10.

Figure 15:
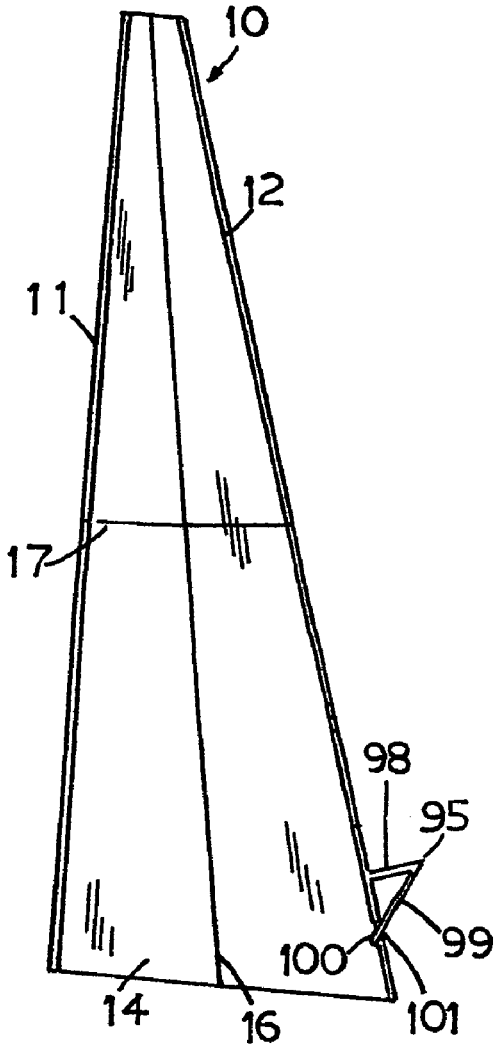
FIG. 15 is a sectional side elevation view of the foldable support stand of FIG. 14 with the abutment in the erected condition.
Figure 14:
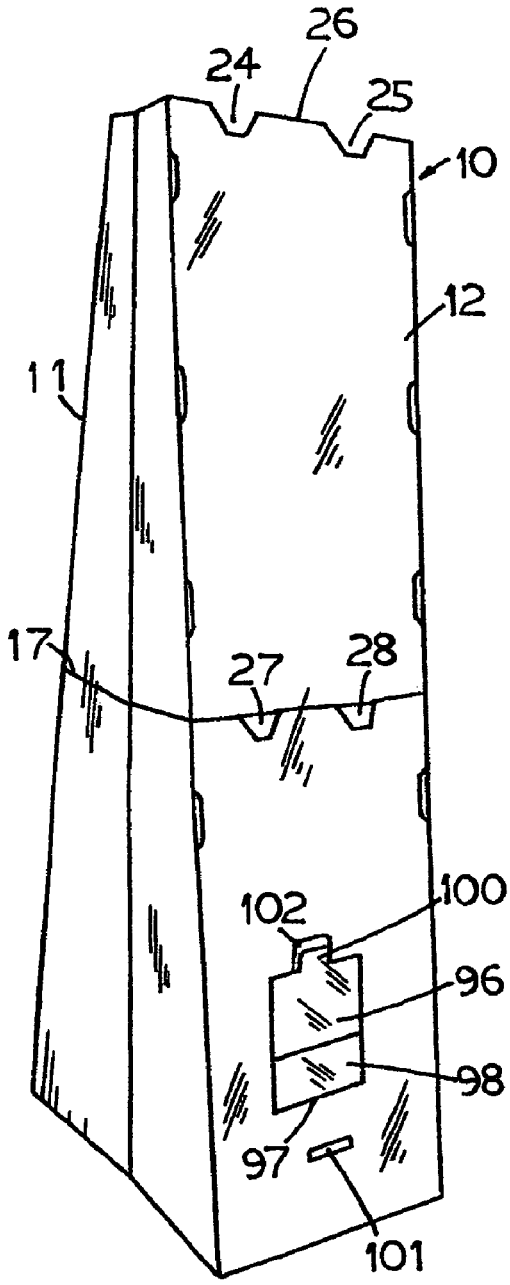
FIG. 14 is a front and left side perspective view of the foldable support stand of the present invention having a rectangular pattern stamped at the central lower portion of the front panel which may be pulled forward and folded outwards to form an abutment to provide an additional support for the display casing mounted on the support stand.

As shown in FIGS. 14 and 15, an abutment 95 may be provided on the front panel 12 and located just below the casing 41. The abutment 95 may be formed by another scored rectangular pattern 96 formed in the lower portion of the front panel 12. The pattern 96 has three scored sides and a foldable side 97 which is foldable relative to the front panel 12 similar to the scored pattern of the upper brace 21. The pattern 96 may be pulled outward of the front panel 12 and then foldable outward relative to the front panel 12 along its foldable edge 97. It has a lower portion 98 and a top portion 99 with a mounting tab 100 located at the upper edge of the top portion 99. After it has been pulled and pivoted outwards along its foldable side 97 to the position perpendicular to the front panel 12, the upper portion 99 may then be bent downwards to a skewed position until the mounting tab 100 engages with a horizontal latching slot 101 located below the pattern 96 for maintaining the abutment 95 in the rigidly supported manner. An extended opening 102 is formed in the front panel 12 above the mounting tab 100 so as to facilitate the pulling of the scored pattern 96 outwards from the front panel 12.

Although the present invention has been shown and described with respect to specific details of a certain preferred embodiment, it is not intended that such details limit the scope and coverage of the invention other than as expressly set forth in the following claims, keeping in mind reasonable equivalent variations thereof.

What is claimed is:

1. A tilt back merchandise display stand comprising:

a rectangular vertical rear panel, a rectangular front panel, said front panel being tilted rearwards towards said rear panel at a top edge therein, two triangular side panels being foldable vertically along a middle vertical fold line therein until said rear panel and said front panel lying juxtaposed to one another, a horizontal fold line located at a generally middle position of said rear panel, said side panels, and said front panel, said display stand being foldable along said horizontal fold line after said side panels having been folded, to a collapsed condition, a brace panel located within said stand, said brace panel having one edge therein mounted to said front panel, said brace panel being pivotable in a cantilever manner to a transverse position within said stand, an elastic cord connected to said brace panel and said rear panel of said display stand, said elastic cord being in an elastic tension when said brace panel is pivoted downwards to lie juxtaposed to said front panel to facilitate folding of said stand to said collapsed condition, a mounting tab formed at a second edge of said brace panel and located opposite to said one edge of said brace panel, a latching slot formed at said rear panel, said mounting tab of said brace panel being engageable with said latching slot for maintaining said brace panel in said transverse position, two spaced open mounting slots formed at an upper edge of said front panel, a plurality of vertical mounting slots formed along two side edges of said front panel, said vertical mounting slots being spaced, and positioned directly opposite to one another in said two side edges, a plurality of separate merchandise display trays removably mountable to said vertical mounting slots of said front panel, said separate merchandise display trays having an identical construction and having two opposite upstanding side walls sloping downwardly and forwardly from a higher rectangular rear wall to a lower front wall and having an L-shaped tab extending rearwardly and upwardly from a top rear corner of said side walls of said merchandise display trays, a selected number of said separate merchandise display trays being removably mountable to said front panel of said display stand by engaging said L-shaped tab on said opposite upstanding side walls with selected vertical mounting slots located on directly opposite positions of said side edges of said front panel of said display stand.

* * * * *